United States Patent [19]

Usami et al.

[11] 3,949,183

[45] Apr. 6, 1976

[54] COVER PLATE FOR INDUCTION HEATING APPARATUS

[75] Inventors: Kazuo Usami, Itami; Masayuki Miyazaki, Osaka; Akemi Hizikata, Kawanishi, all of Japan

[73] Assignee: Mitsubishi Denki Kabushiki Kaisha, Tokyo, Japan

[22] Filed: July 15, 1974

[21] Appl. No.: 488,777

Related U.S. Application Data

[63] Continuation of Ser. No. 367,898, June 7, 1973, abandoned.

[30] Foreign Application Priority Data

Oct. 20, 1972 Japan ..... 47-104948
Jan. 23, 1973 Japan ..... 48-9697

[52] U.S. Cl. ..... 219/10.49; 219/10.67; 219/464
[51] Int. Cl.[2] ..... H05B 5/04
[58] Field of Search ..... 219/10.49, 10.79, 464, 219/459, 521, 421, 10.67; 126/390, 39 J, 39 H, 39 K, 211, 214 B, 216, 400

[56] References Cited

UNITED STATES PATENTS

| | | | |
|---|---|---|---|
| 2,127,426 | 8/1938 | Samuels | 219/464 X |
| 2,196,484 | 4/1940 | Wentworth | 219/464 X |
| 2,422,057 | 6/1947 | Weinhardt | 219/459 |
| 3,275,784 | 9/1966 | Merrett | 219/10.49 |
| 3,530,499 | 9/1970 | Schroeder | 219/10.49 |
| 3,710,062 | 1/1973 | Peters | 219/10.49 |
| 3,715,550 | 2/1973 | Harnden et al. | 219/10.49 |
| 3,767,896 | 10/1973 | Ryan | 219/521 |
| 3,781,503 | 12/1973 | Harnden et al. | 219/10.79 |
| 3,836,744 | 9/1974 | Taketo et al. | 219/10.49 |

FOREIGN PATENTS OR APPLICATIONS

| | | | |
|---|---|---|---|
| 1,157,711 | 7/1969 | United Kingdom | 219/10.49 |
| 446,410 | 4/1936 | United Kingdom | 219/464 |

*Primary Examiner*—Bruce A. Reynolds
*Attorney, Agent, or Firm*—Oblon, Fisher, Spivak, McClelland & Maier

[57] ABSTRACT

An induction heating apparatus for induction-heating a heated element such as a cooking pot by an exciter which forms an alternating magnetic field excited by the standard line frequency. The apparatus comprises a cover plate made of a high resistant non-magnetic metal, preferably stainless steel, placed above said exciter to face said heated element. Preferred embodiments of the cover plate for absorbing thermal expansion include the formation of a rim between a central region (supporting surface) on which is placed said heated element and a peripheral region; formation of a circular projection or a groove projecting upwardly or downwardly at a peripheral part in said central region or formation of a curved surface in the inner region of the peripheral circular projection or groove of said central region.

17 Claims, 38 Drawing Figures

30

C – C

D – D

C – C

D – D

B — B

C — C

COVER PLATE FOR INDUCTION HEATING APPARATUS

This is a continuation, of application Ser. No. 367,898, filed June 7, 1973, abandoned.

BACKGROUND OF THE INVENTION

1. Field of the Invention

This invention relates to an induction heating apparatus, and more particularly to such an apparatus in which the thermal deformation of a cover plate is absorbed so as to decrease the change in distance between an exciter and a heated element caused by the thermal expansion.

Even more particularly, the induction heating apparatus of the present invention finds effective use as an induction heating cooking apparatus (cooker), and accordingly, the invention will be illustrated and described with respect to an induction heating cooking apparatus.

2. Description of the Prior Art

The principle of induction heating apparatus is to generate heat by applying electric power of the standard line frequency to an exciter in the body of the apparatus, for example a cooking pot. An eddy current is induced at the bottom of the cooking pot above the exciter by the alternating magnetic field generated from the exciter. Heat is generated mainly by the eddy current and the electric resistance at the bottom of the cooking pot.

In such apparatus of the prior art an exciter is normally exposed so as to put the cooking pot in direct contact with the exciter. Such apparatus has disadvantages in unsightly appearance as a household apparatus and also is dangerous when water or other contents of the pot overflows.

Accordingly, consideration has been given to placing a flat cover plate facing the cookpot above the exciter, thereby protecting the exciter and improving the appearance and cleanliness of the apparatus. As a cover plate, it is preferable in practical application to use a plate made of non-magnetic metal having a relatively high electric resistivity, such as stainless steel. It is also preferable to use a thin cover plate for increasing the efficiency of the induction heating apparatus. However, when a flat thin stainless steel plate is used, the stainless steel cover plate is heated to cause thermal expansion and subsequent thermal deformation of the cover plate.

The thermal expansion of the cover plate is caused by the transmission of a part of the heat at the bottom of the cooking pot resulting from the induction heating of the cooking pot by the exciter, so as to heat the cover plate, whereby the temperature of the cover plate in contact with the cookpot will be higher than that of the non-contacting portion of the cover plate. Due to the temperature gradient produced thereby the part of the cover plate in contact with the cooking pot causes a higher thermal expansion that the non-contacting part of the cover plate, whereby a thermal buckling is caused and the central region in contact with the cooking pot is upwardly or downwardly curved and deformed. As a result, the cookpot is undesirably separated from the exciter to decrease the efficiency of the induction heating apparatus and to increase the vibration and noise because of the unstable condition of the cooking pot.

In general, the thermal stress and thermal deformation are related to each other in that when the thermal deformation is decreased, the thermal stress is increased. However, in accordance with this invention, the thermal deformation of the cover plate will be absorbed so as to minimize the distance between the cooking pot and the exciter. The apparatus is safe while reducing vibration and noise, even though the central part of the cover plate still expands by heat generated during cooking.

SUMMARY OF THE INVENTION

Accordingly, it is a primary object of the present invention to provide an induction heating apparatus wherein the effects of thermal deformation of the cover plate thereof are minimized.

Another object is to provide an induction heating apparatus for particular use as cooking apparatus wherein improved efficiency and reduction in noise and vibration can be obtained.

The foregoing and other objects are attained in accordance with one aspect of the present invention through the provision of an induction heating apparatus having an exciter for induction-heating a heated element such as a cooking pot. An alternating magnetic field is formed and a cover plate made of a high resistant non-magnetic metal, preferably stainless steel, is placed above said exciter to face said heated element. A rim is formed between the central region supporting the cooking pot and the peripheral region of the cover plate so as to prevent thermal deformation of the cover plate, to increase the efficiency of the cooking pot, and to prevent an increase in vibration and noise during heating.

In one embodiment of this invention, the central region of the cover plate supporting the cooking pot is formed to have an upward or downward rim from the peripheral region of the cover plate.

In another embodiment, a circular projection or groove, or a plurality thereof, projected upwardly or downwardly at a peripheral part of the central region is formed on the central region of the cover plate.

In still another embodiment of this invention, an inner region surrounded by the circular projection or groove at the central region is formed in convex facing either upward or downward.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIGS. 1 through 5 show various views of a preferred embodiment of the induction heating apparatus according to this invention, wherein:

FIG. 1 is a sectional perspective view of the induction heating apparatus;

FIG. 2 is a perspective view of the cooking pot of FIG. 1;

FIG. 3 is a sectional perpsective view of the cover plate of FIG. 1;

FIG. 4 is a partially sectional perspective view of the body (range table) of the apparatus of FIG. 1; and FIG. 5 is a diagram illustrating the thermal deformation of the cover plate of FIG. 1;

FIGS. 15 through 17 show another embodiment of the induction heating apparatus according to this invention, wherein:

FIG. 15 is a sectional perspective view of the cover plate; and

FIGS. 16 and 17 are views which illustrate the structure of the cover plate of FIG. 15;

FIGS. 20 to 22 are views of still another embodiment according to this invention, wherein:

FIG. 20 is a sectional perspective view thereof; and

FIGS. 21 and 22 are sectional view of the embodiment of FIG. 20 with the cooking pot in place;

FIGS. 24 and 25 are views of another embodiment of a cover plate, wherein:

FIG. 24 is a sectional perspective view of the cover plate; and

FIG. 25 is a sectional view illustrating the cover plate of FIG. 24;

FIGS. 28A through D show other embodiments according to this invention, wherein:

FIG. 28A is a perspective view of a cover plate;

FIG. 28B is a partial front view of a projection of the cover plate;

FIG. 28C is a sectional view taken along line C-C of FIG. 28B; and

FIG. 28D is a sectional view taken along line D-D of FIG. 28B;

FIGS. 29A through D show stil other embodiments according to this invention, wherein:

FIG. 29A is a perspective view of a cover plate;

FIG. 29B is a partial front view of the projection of FIG. 29A;

FIG. 29C is a sectional view taken along line C—C of FIG. 29B; and

FIG. 29D is a sectional view taken along line D—D of FIG. 29B;

FIGS. 30A through C show still another embodiment according to this invention, wherein:

FIG. 30A is a sectional perspective view of a cover plate;

FIG. 30B is a sectional view taken along line B—B of FIG. 30A; and

FIG. 30C is a sectional view taken along line C—C of FIG. 30A.

DETAILED DESCRIPTION OF THE PREFERRED EMBODIMENTS

Figure 1:
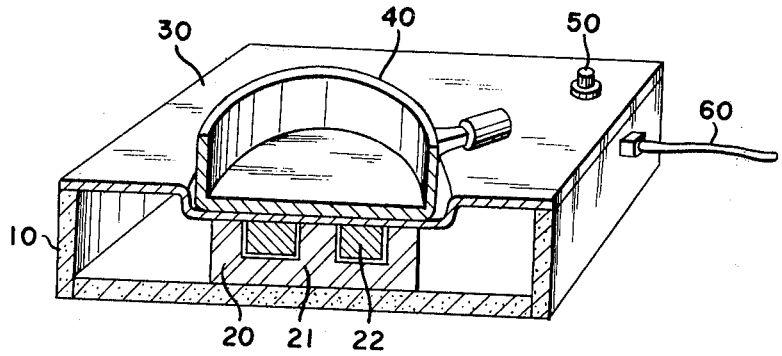
Figure 2:
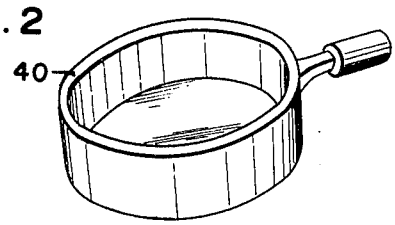

Referring now to the drawings, wherein like reference numerals designate identical or corresponding parts throughout the several views, and more particularly to FIGS. 1 through 4 thereof, one embodiment of the induction heating apparatus according to this invention is illustrated as a cooking apparatus wherein a body (range table) 10 has an exciter 20 and a cover plate 30. The exciter 20 comprises an iron core 21 and an excitation winding 22. The cover plate 30 is made of a plate of non-magnetic metal having a relatively high electric resistivity (hereinafter referred to as a high resistant non-magnetic metal), preferably being a stainless steel plate. A heated element such as a cooking pot 40, which is induction-heated by the exciter 20, can be, for example, made of a copper pot or iron. A cooking pot having, for example, a copper-iron plating (the bottom being formed by an iron plate having a thickness of 0.1 – 2.0 mm bonding a copper plate having a thickness of 0.2 – 1.7 mm on the outer surface) imparts high efficiency when excited by the standard line frequency. Reference numeral 50 designates a switch and 60 designates a power source cord.

The principle of operation is to generate heat at the bottom of the cooking pot 40 by generating an alternating magnetic field by applying electric power of the standard line frequency to the exciter 20 in the body 10 and inducing eddy currents by electromagnetic induction at the metal bottom of cooking pot 40 placed on the exciter and heating the bottom of cooking pot 40 by the eddy currents. The cover plate 30 has a rim 33 having a height of $h$ at the boundary between the higher temperature part 31 and the lower temperature part 32, forming a convex with the lower temperature part without leveling both the higher temperature part 31 in contact with the cookpot 40 and the lower temperature part 32 of the peripheral part, whereby thermal strain will be absorbed.

Figure 5:
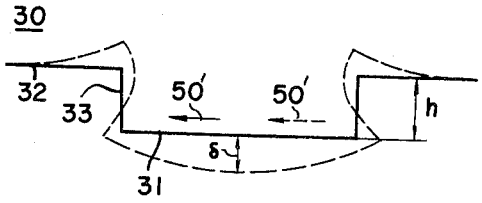

During cooking, the central part 31 is heated and expands outwardly as shown by the arrow line 50′ of FIG. 5. The cover plate 30 is deformed by the thermal strain as shown by the dotted line. The value $\delta$ of the center of deformation is much smaller than that of a flat cover plate, and the total behavior of the cover plate 30 is reproducible. Accordingly, the cookpot 40 will be supported on the cover plate 30 in a relatively stable condition.

The height $h$ of the rim 33 between the central part 31 and the peripheral part 32 of the cover plate 30 is chosen depending upon the temperature gradient and the linear expansion coefficient of the cover plate 30. In a practical cooking apparatus, the height $h$ of the rim 33 can be about 10 mm. The boundary between the central part 31 and the peripheral part 32 of the cover plate 30 is not necessarily circular but can be rectangular, depending upon the shape of the cooking pot 40.

In this invention, stainless steel is preferably used as the cover plate 30. Stainless steel is the optimum mateial for use as a high resistant non-magnetic material. This becomes apparent when considering the following requisites for the selection of the material for the cover plate 30.

1. A non-magnetic metal having a high resistivity must be used;
2. the distance between heated element 40 and exciter 20 must be kept less than several mm;
3. it must be durable under high temperatures (lower than 500°C);
4. its mechanical strength must be high; and
5. the temperature of the cover plate 30 must be kept lower than around 60°C except the part in contact with heated element 40. The first condition is to ensure sufficient permeation depth of the alternating magnetic field generated by the exciter 20 in the bottom of the heated element 40. When stainless steel is used, the depth of the permeated alternating magnetic flux resulting from the commercial line frequency is sufficiently deep, on the order of several tens of mm. Accordingly, when stainless steel having a thickness of less than 1 mm is used, the magnetic path for a copper-iron plate having a copper plate thickness of 0.2 – 1.7 mm will not be deteriorated. Accordingly, it is possible to obtan a calorific value which is similar to that of the induction heating apparatus using a glass type non-metallic plate. It is necessary for the cover plate 30 to have a high resistance, quite higher than that of the heated element 40, in order to increase the calorific value of eddy current in the cover plate 30. In this regard, stainless steel has a high inherent resistance which is about several tens times that of the heated element (such as a copper cooking pot). Accordingly, the calorific value resulting from eddy current passing through the stainless steel is quite small, on the order of 2 – 3% of that of the heated element (cooking pot). Accordingly, the efficiency of the induction heating apparatus will not be decreased.

The second condition enumerated above is to ensure that a large amount of magnetic flux is passed to the bottom of the heated element 40 by decreasing the distance between the exciter 20 and the heated element 40. It has been found theoretically that the distance should be less than several mm in order to obtain a high electrical efficiency.

The third condition is to provide durability agaist thermal shock. If the requirement is only that the material does not soften at high temperatures, it is possible to use a glass type material. However, glass is not suitable from the viewpoint of breakage which can be caused by erroneous operation and/or handling (such as dropping the heated element 40 on the cover plate 30). Accordingly, a metallic material is preferable.

The fourth condition is obviously to provide a material and structure which can not be broken by careless handling.

The fifth condition is to ensure safety by preventing personal injury resulting from touching the cover plate 30 by maintaining a low temperature of all parts except the heated element 40. It is necessary to transmit the heat of the heated element 40 to the cover plate 30 for said purpose. The thickness of the cover plate 30 at the part in contact with the heated element 40 should be minimized for the foregoing purpose. However, on the other hand, it is necessary to support the weight of the heated element (cooking pot) 40 and the contents (cooked material) by the cover plate, and accordingly, it will be necessary to have a thickness of the cover plate in the range of 1 – 0.3 mm.

Thus, it is readily appreciated that stainless steel having a thickness less than 1 mm will be practical and extremely satisfactory to satisfy the foregoing above five conditions. However, this invention is not limited to a stainless steel plate having a thickness less than 1 mm. Thus, a cover plate havng a high thermomechanical strength without decreasing its thermal efficiency can be provided by using a stainless steel cover plate.

Other embodiments of cover plates of the induction heating apparatus according to this invention are illustrated in FIGS. 6 to 14.

Figure 6:
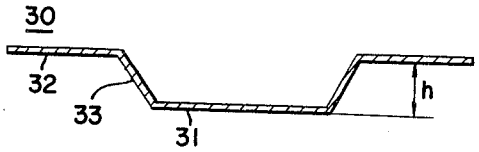
FIGS. 6 through 14 are sectional views of various embodiments of the cover plate according to this invention.

FIG. 6 is a sectional view of the cover plate having a shape of

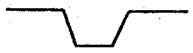

Figure 7:
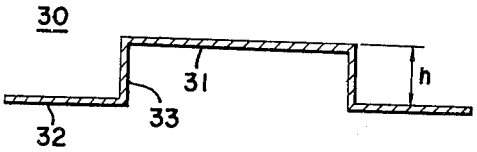
Figure 8:
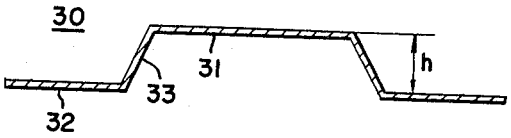

FIGS. 7 and 8 are sectional views of the cover plate having a shape of

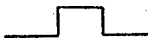

and

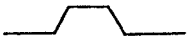

respectively.

Figure 3:
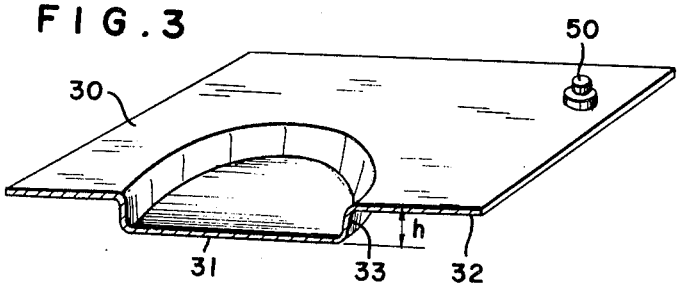
Figure 4:
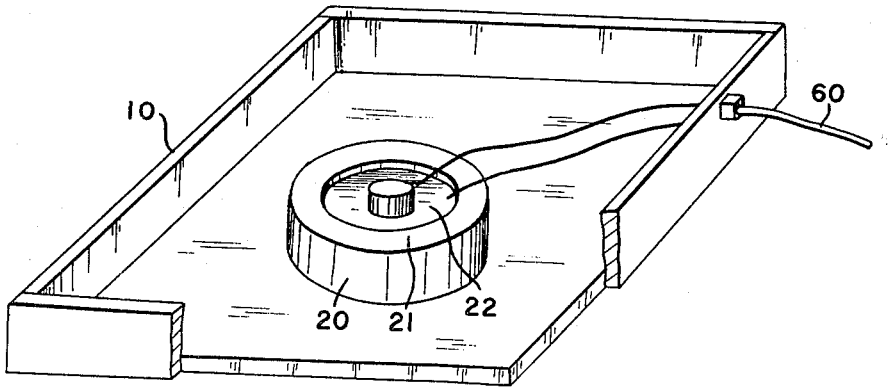
Figure 9:
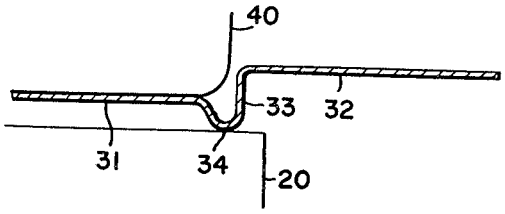

FIG. 9 shows a modification of the cover plate of FIG. 3 wherein a channel 34 is formed between the periphery of the central part 31 and rim 33.

Figure 10:
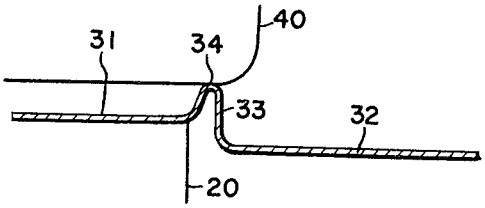

FIG. 10 shows a modification of the cover plate of FIG. 9 wherein channel 34 is formed upwardly, so that the thermal expansion of the cover plate 30 will be well absorbed.

Figure 11:
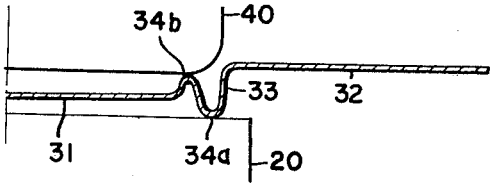
Figure 12:
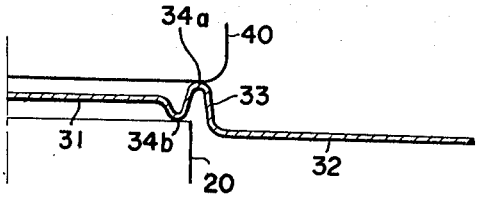

FIG. 11 is a sectional view of the cover plate 30 having a pair of thermal strain absorption channels or grooves 34*a* and 34*b* projecting downwardly and upwardly, respectively, between the periphery of the central part 31, and rim 33. FIG. 12 shows a modification of FIG. 11 with grooves 34*a* and 34*b* facing upwardly and downwardly, respectively.

Figure 13:
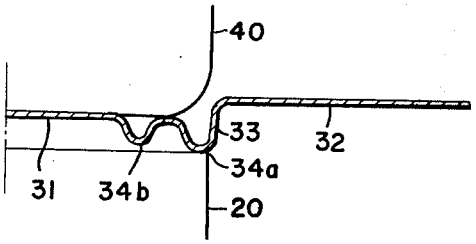
Figure 14:
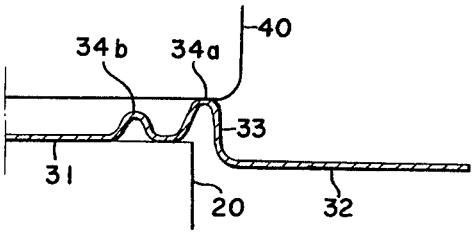

FIG. 13 is a sectional view of a cover plate having two thermal absorption grooves 34*a* and 34*b* both projecting downwardly. FIG. 14 shows a modification of FIG. 13 with grooves 34*a* and 34*b* facing upwardly, wherein the cooking pot 40 is supported by only one of the grooves 34*a* for stability.

The groove 34 for absorbing the thermal strain formed on the cover plate can of course comprise a plurality of circular grooves. The size of the groove 34 can be chosen after a consideration of the temperature gradient formed in the cover plate and the thermal expansion coefficient of the cover plate. For example, the sectional view of the circular groove 34 can be in the shape

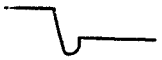

wherein the curve of the groove has a radius of 3 mm and a height of 2 mm.

Figure 15:
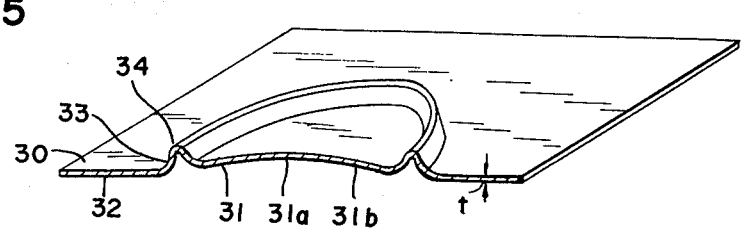

FIG. 15 is a partially sectional perspective view of one embodiment of the cover plate of the induction heating cooking apparatus according to this invention with an upward facing circular groove 34 formed therein.

Figure 16:
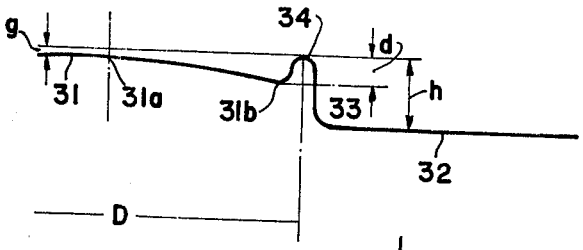
Figure 17:
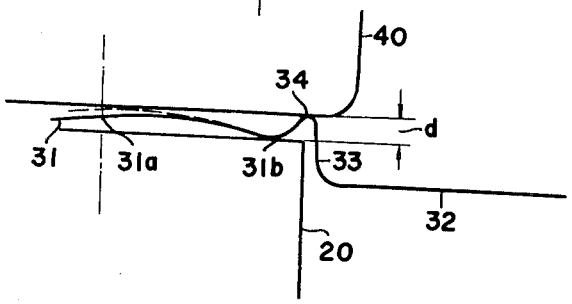

FIGS. 16 and 17 illustrate the behavior of the apparatus shown in FIG. 15. As seen in FIG. 16, the cover plate 30 is formed with an upward convex central part 31 which is of a thin cap shape. The circular groove 34 is positioned higher than the center 31*a* of the cap part 31 so that it does not contact the bottom of the cooking pot 40 by the thermal deformation (shown by the dotted line of FIG. 17) caused by thermal expansion. The exciter 20 and the cover plate 30 are always in contact with each other at the part 31*b*. As the result, the distance d between the exciter 20 and the cookpot 40 is substantially kept constant. The curve of the cap part 31 is upwardly formed, because the force caused at the peripheral part of the cap part 31 is directed to the central part, and in order to prevent a downward deformation of the cap part 31 which would then contact the exciter 20, the direction of the deformation is limited to be upward. The height h of the rim 33 and the distance *g* between the center of the cap 31*a* and the top of the circular groove 34 are important values for providing optimum thermal stress and thermal deformation, and are desirably selected depending upon the gap height *d*, the thickness *t*, and the diameter D of the cap part 31.

In one example of a cooking apparatus constructed according to the present invention, the diameter of the cap part 31 D was 220 mm; the plate thickness *t* was 0.8 mm; the gap height *g* was 2 mm; the height of the rim 33 *h* was 10 mm; and the distance between the top center of the cap part 31*a* and the top of the circular groove 34 *g* was about 0.5 mm.

Figure 18:
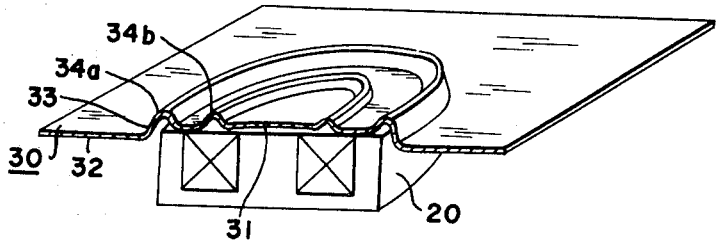
FIGS. 18 and 19 are sectional perspective views of other embodiments according to this invention.
Figure 19:
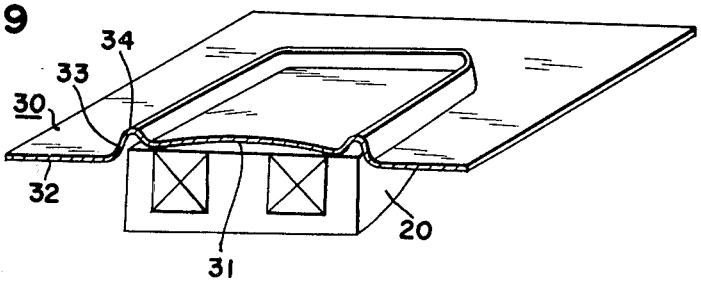

FIGS. 18 and 19 are partially broken away perspective view of the cover plate according to this invention, wherein FIG. 18 shows a modification having a pair of circular grooves 34*a* and 34*b* which can be used for a small cooking pot, and FIG. 19 shows a modification having a rectangular groove.

Figure 20:
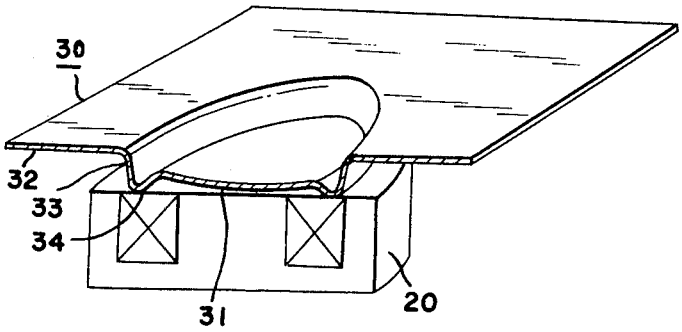
Figure 21:
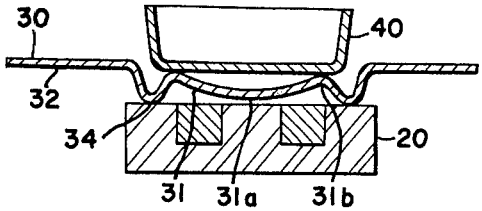
Figure 22:
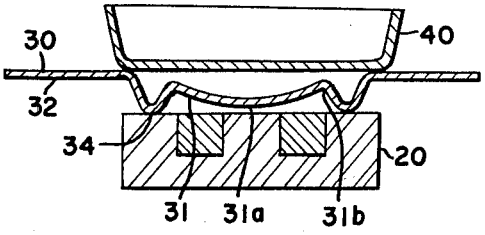

FIG. 20 is a partially borken away perspective view of another embodiment of the plate wherein the top of the convex part 34 is supported by the exciter 20 of the body 10 of the cooking apparatus and the cookpot 40 is supported by the cover plate 31*b* as shown in FIG. 21 or the peripheral flat part 32 of the cover plate 30 as shown in FIG. 22, whereby the top central part 31*a* of the cap part 31 does not contact the exciter 20 during heating.

Figure 23:
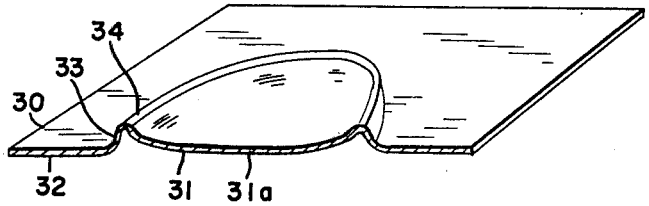
FIG. 23 is a sectional perspective view of a cover plate.

In the foregoing embodiments, the cap part 31 is formed convex to the direction of the circular groove 34. However, it is possible to form it convex in the opposite direction as shown in FIG. 23, so long as it does not contact the exciter 20 during heating. As stated above, in accordance with this invention, even though the heat of the cooking pot is transmitted to the cover plate which creates thermal strain, the deformation of the cover plate is small and the distance between the exciter and the cooking pot is substantially constant, whereby it is possible to obtain an induction heating cooking apparatus having stable thermal efficiency and little noise.

Figure 24:
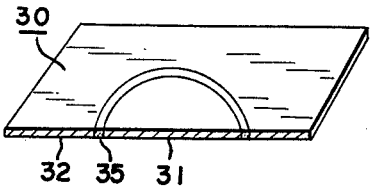
Figure 25:
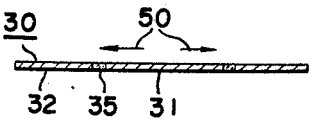

Another embodiment of the cover plate is illustrated in FIG. 24, wherein the central part 31 of the cover plate 30 is formed in a circular shape from the peripheral part 32 and a silicon rubber packing 35 having an elastic coefficient of about 5 kg/mm$^2$ is placed in the space between the central part 31 and the peripheral part 32 in order to absorb the thermal strain. During cooking, when the temperature of the central part 31 is increased, the central part will be expanded outwardly as shown by the arrows 50' of FIG. 25. However, the expansion will be absorbed by the silicon rubber packing 35. Accordingly, the central part 31 of the cover plate 30 will be freely elongated without deforming the peripheral part 32 so as to keep the cover plate flat. The size of the gap between the cover plate portions 31 and 32 is determined depending upon the temperature gradient generated on the cover plate 30 and the linear expansion coefficient of the cover plate. For example, the gap can be about 10 mm. The material which comprises the central part 31 of the cover plate 30 does not necessarily have to be the same as that of the peripheral part 32. For example, it is possible to use a glass plate having a low linear expansion coefficient as the central part 31 and to use a stainless steel plate as the peripheral part 32.

Figure 26:
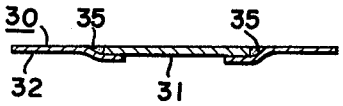
FIGS. 26 and 27 are sectional views of still another embodiment of a cover plate.
Figure 27:
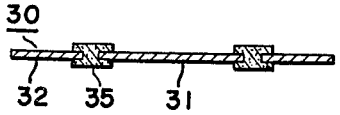

A still further embodiment of the cover plate is illustrated in FIG. 26, wherein the central part 31 is supported by the peripheral part 32 and a heat resistant material 35 for thermal strain absorption is inserted in the gap therebetween. In FIG. 27 of the sectional view, the cover plate portions 31 and 32 are fitted with a heat resistant material having an "I" sectional shape, wherein the heat resistant material 35 for heat strain absorption should not be bonded with the cover plates 31 and 32. Incidentally, as stated above, it can be effective to utilize different materials for cover plate portions 31 and 32.

Thus, in the embodiments of FIGS. 24 – 27, a plurality of cover plate portions are connected by a heat resistant material for thermal strain absorption, as a cover between the exciter and the cooking pot, and accordingly, the thermal deformation of the cover plate can be prevented. Especially in an induction heating cooking apparatus, even though the heat of the cooking pot is transmitted to the cover plate to cause thermal strain, no deformation is formed in the cover plate, so that an induction heating cooking apparatus having stable thermal coefficients and small noise can be obtained.

Figure 28A:
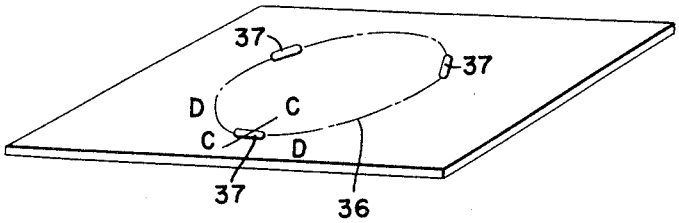
Figure 28B:
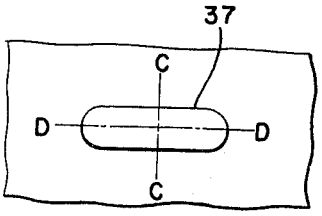
Figure 28C:
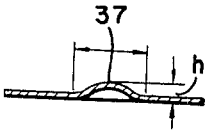
Figure 28D:
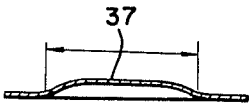
Figure 29A:
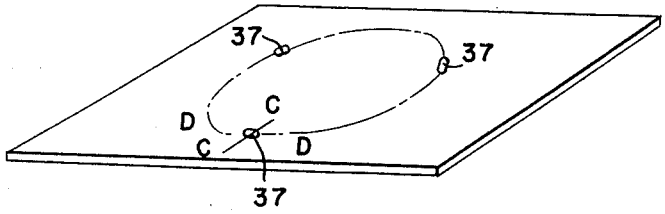
Figure 29B:
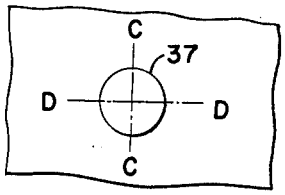
Figure 29C:
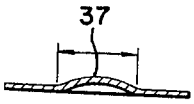
Figure 29D:
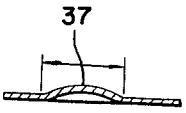

Another embodiment of the cover plate is illustrated in FIGS. 28A – D, wherein the cover plate 30 has three projections 37 positioned an equal distance on pitch circle 36, which has a smaller radius than that of the bottom of the cooking pot at the central part thereof. Cover plate 30 can be prepared by pressing a stainless steel plate having a thickness of about 1 mm. The projections have a plan view as seen in FIG. 28B and sectional views taken along lines C—C and D—D respectively, as seen in FIGS. 28C and D. It is seen that the projections are relatively higher than the flat surface of plate 30 and that the height *h* of the projections is higher than the local concavo-convex portion, such that *h* is 0.5 –1 times the thickness (e.g., about 0.8 mm), the width of the projections is about 10 times the thickness and the length of the projections is about 30 times the thickness of the plate. The cooking pot 40 is always supported at the three projections formed on the cover plate 30 so that the apparatus is in a stable condition and noise and vibration are decreased.

Figure 30A:
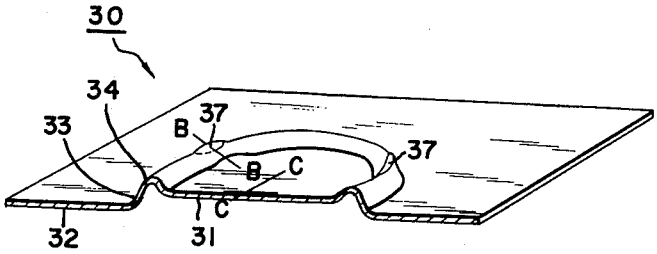
Figure 30B:
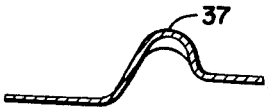
Figure 30C:
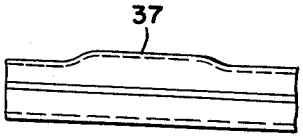

Other embodiments of the cover plate are illustrated in FIGS. 29A – D and FIGS. 30A – C. FIGS. 29A – D shows a modification of the embodiment of FIGS. 28A – D wherein spherical projections 37 are formed instead of the elliptical projections of FIGS. 28A – D. In FIGS. 30A – C, three projections 37 are formed on a circular groove 34 which is formed in the cover plate 30. Obviously, the number of projections 37 are not limited to three. In accordance with the embodiments of FIGS. 29A – D and 30A – C, even though a local deformation or a curve is formed on the cover plate, the cooking pot is always supported by the projections and the induction heating apparatus (cooking apparatus) having very little noise and vibration and a stable operating condition can be obtained.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. Induction heating apparatus comprising:

exciter means for generating an alternating magnetic field for induction heating a heated element, a cover plate disposed above said exciter means for supporting the heated element at a predetermined distance from said exciter means, said cover plate comprising, a center part maintained out of contact with said heated element and said exciter means, a peripheral part maintained out of contact with said heated element and said exciter means surrounding said center part, thermal absorbing means connecting said center part of said pheripheral part, supporting the heated element and supported by said exciter means, said thermal absorbing means being of sufficient height to maintain said center part and said peripheral part out of contact with the heated element and said exciter means even after thermal deformation of said cover plate to maintain the heated element and said exciter means at a predetermined separation.

2. The induction heating apparatus according to claim 1 wherein said absorbing means comprises a circular upward groove.

3. The induction heating apparatus according to claim 2 wherein the center part is convex or concave.

4. The induction heating apparatus according to claim 2 wherein at least three projections are formed on the circular upward groove.

5. The induction heating apparatus according to claim 4 wherein the center part is convex or concave.

6. The induction heating apparatus according to claim 1 wherein said absorbing means comprises a circular upward groove and a circular downward groove spaced outwardly with respect thereto.

7. The induction heating apparatus according to claim 6 wherein the center part is convex or concave.

8. The induction heating apparatus according to claim 6 wherein at least three projections are formed on the circular upward groove.

9. The induction heating apparatus according to claim 8 wherein the center part is convex or concave.

10. The induction heating apparatus according to claim 1 wherein said absorbing means comprises a circular upward groove and a circular downward groove spaced inwardly with respect thereto.

11. The induction heating apparatus according to claim 10 wherein the center part is convex or concave.

12. The induction heating apparatus according to claim 10 wherein at least three projections are formed on the circular upward groove.

13. The induction heating apparatus according to claim 12 wherein the center part is convex or concave.

14. The induction heating apparatus according to claim 1 wherein said absorbing means comprises two circular upward grooves.

15. The induction heating apparatus according to claim 14 wherein the center part is convex or concave.

16. The induction heating apparatus according to claim 14 wherein at least three projections are formed on the circular upward grooves.

17. The induction heating apparatus according to claim 16 wherein the center part is convex or concave.

* * * * *